US009586209B2

(12) United States Patent
Rikkonen et al.

(10) Patent No.: US 9,586,209 B2
(45) Date of Patent: Mar. 7, 2017

(54) DRIVING OF ROTATING CRUSHER ELEMENTS

(71) Applicant: Metso Minerals, Inc., Helsinki (FI)

(72) Inventors: Kari Rikkonen, Tampere (FI); Jari Jonkka, Kangasala (FI); Marko Salonen, Tampere (FI); Risto Sutti, Tampere (FI); Kari Kuvaja, Tampere (FI); Petri Kujansuu, Tampere (FI)

(73) Assignee: Metso Minerals, Inc., Helsinki (FI)

( * ) Notice: Subject to any disclaimer, the term of this patent is extended or adjusted under 35 U.S.C. 154(b) by 336 days.

(21) Appl. No.: 14/370,094

(22) PCT Filed: Dec. 17, 2012

(86) PCT No.: PCT/FI2012/051251
§ 371 (c)(1),
(2) Date: Jul. 1, 2014

(87) PCT Pub. No.: WO2013/102700
PCT Pub. Date: Jul. 11, 2013

(65) Prior Publication Data

US 2015/0001323 A1 Jan. 1, 2015

(30) Foreign Application Priority Data

Jan. 3, 2012 (FI) ..... 20125006

(51) Int. Cl.
*B02C 13/30* (2006.01)
*B02C 1/02* (2006.01)
(Continued)

(52) U.S. Cl.
CPC ..... *B02C 13/30* (2013.01); *B02C 1/02* (2013.01); *B02C 4/02* (2013.01); *B02C 4/42* (2013.01);
(Continued)

(58) Field of Classification Search
USPC ..... 241/189.1
See application file for complete search history.

(56) References Cited

U.S. PATENT DOCUMENTS 4,192,471 A * 3/1980 Beckman ..... B02C 4/42 100/172
6,149,086 A 11/2000 Young et al.
2003/0127550 A1 7/2003 Stemper

FOREIGN PATENT DOCUMENTS

DE 29 27 738 A 1/1980
DE 41 10 643 A1 10/1992
(Continued)

OTHER PUBLICATIONS

PCT International Search Report dated May 8, 2013.
(Continued)

*Primary Examiner* — Mark Rosenbaum
(74) *Attorney, Agent, or Firm* — Andrus Intellectual Property Law, LLP

(57) ABSTRACT

A mineral material crusher and method of operating a mineral material crusher that includes: a body, a rotating crusher element, a drive shaft arrangement that supports the rotating crusher element to the body and to rotate the rotating crusher element, and a motor including a rotor for driving the drive shaft arrangement. The motor is formed inside the rotating crusher element and the drive shaft arrangement is configured to form of the rotor a rotating axle that is rigidly coupled with the rotating crusher element and capable of leading torque from the rotor to the rotating crusher element for rotating the crusher element around the drive shaft.

19 Claims, 9 Drawing Sheets

(51) Int. Cl.

| | |
|---|---|
| ***B02C 4/02*** | (2006.01) |
| ***B02C 4/42*** | (2006.01) |
| ***B02C 13/09*** | (2006.01) |
| ***B02C 13/18*** | (2006.01) |

(52) U.S. Cl.
CPC ..... *B02C 13/09* (2013.01); *B02C 13/095* (2013.01); *B02C 13/1807* (2013.01); *B02C 13/1814* (2013.01)

(56) References Cited

FOREIGN PATENT DOCUMENTS

| | | | |
|---|---|---|---|
| EP | 2 545 994 | A1 | 1/2013 |
| FI | 20689 | A | 11/1945 |
| JP | 2000325822 | A | 11/2000 |
| WO | 2009/067828 | A1 | 6/2009 |

OTHER PUBLICATIONS

PCT Written Opinion of the International Searching Authority dated May 8, 2013.
Response to Written Opinion dated Oct. 31, 2013.
PCT International Preliminary Report on Patentability dated Dec. 16, 2013.
Finland Search Report dated Oct. 12, 2012.

* cited by examiner

DRIVING OF ROTATING CRUSHER ELEMENTS

CROSS-REFERENCE TO RELATED APPLICATIONS

This application claims priority to PCT/FI2012/051251, filed Dec. 17, 2012, and published in English on Jul. 11, 2013 as publication number WO 2013/102700, which claims priority to FI Application No. 20125006 filed Jan. 3, 2012, incorporated herein by reference.

TECHNICAL FIELD

The present invention generally relates to driving of rotating crusher elements. The invention relates particularly, though not exclusively, to driving of rotating crusher elements of crushers for mineral-based materials.

BACKGROUND ART

Mineral material such as rock is gained from the earth for crushing by exploding or excavating. Rock can also be natural and gravel or construction waste. Mobile crushers and stationary crushers are used in crushing. An excavator or wheeled loader loads the material to be crushed into the crusher's feed hopper from where the material to be crushed may fall in a jaw of a crusher or a feeder moves the rock material towards the crusher. The mineral material to be crushed may also be recyclable material such as concrete, bricks or asphalt.

Mineral crushers typically operate using an electric motor that drives a crusher element through a power transmission system. A typical crusher comprises a body that supports a crushing unit, an electric motor and power transmission, such as a belt and a pair of belt wheels.

FIG. 1*a* shows an example of a track-mounted mobile horizontal shaft impactor (HSI) crushing station 50. The crushing station comprises a body 51, tracks 52, input conveyor 53, crushing unit 10, output conveyor 55, a motor 54, motor's belt wheel 56, crushing unit's belt wheel 57 and a belt 58.

FIG. 1*b* shows an example of a jaw crusher 920. jaw crushers a suitable for example coarse crushing at quarries or for crushing of construction material. According to the function principle of the jaw crusher the crushing takes place against jaws, the so called fixed and movable jaw. The body 1 of the jaw crusher is formed of a front end and a rear end and side plates. The fixed jaw 9 is attached to the front end of the jaw crusher which is receiving the crushing forces. The movable jaw 8 is attached to a pitman 4 and the eccentric movement of the pitman is generated by rotating an eccentric shaft 5. The jaw crusher comprises additionally a belt wheel 913, V-belts 912, a motor 911 and a belt wheel of the motor for moving the movable jaw 8. Mineral material is crushed between the jaws 8, 9 and is proceeding after the crushing for example via a belt conveyor to further processing.

The jaw crusher 920 comprises further an adjusting apparatus 2 for changing the working angle of the pitman 4 which adjusting apparatus is connected to the pitman via a toggle plate 6. A return rod 7 and a return spring 7' are pulling the pitman towards the adjusting apparatus and at the same time keeping the clearances as small as possible at both ends of the toggle plate.

FIG. 1*c* shows an example of a track-mounted mobile jaw crushing station 900. The crushing station comprises a body 901 and tracks 902 for moving the crushing plant, a feeder 903 such as a vibrating feeder for feeding material into a jaw crusher 910 and an output conveyor 905 such as a belt conveyor for conveying material for example to the following crushing phase, a motor 911, motor's belt wheel 915, crushing unit's belt wheel 913 and a belt 912. The crushing station comprises also a motor unit 904 comprising for example a diesel motor.

V-belts 912 and belt wheels 913 and 915 are used for coupling the power source to the jaw crusher in prior art. The motor 911 such as a hydraulic or an electric motor is fixed typically to the body of the jaw crusher directly or by a separate motor bed 914 which is a subframe between the body 1 of the jaw crusher and the motor 911. Alternatively the motor is fixed to the body 901 of the crushing station 900 by beans of a corresponding subframe 934.

It appears clearly in FIGS. 1*a* and 1*c* that the belt-based power transmission and the motor reserve substantial space and increase the size of the crusher. Moreover, to reduce peak strains on the belt, the crushing unit is provided with a flywheel. The belt-based power transmission also requires protective covering around the belt and belt wheels to avoid injuries of the users. The belt-based power transmission also easily excites resonant vibration through the body to associated material conveyors. The resonant vibration causes noise and incurs substantial stress in various structures and therefore necessitates heavier and more robust implementation both in the crushing unit itself, in the body of the crusher and in various other structures connected to the crushing unit.

It is an object of the invention to avoid or mitigate problems related to prior known crushers or at least to advance the technology by developing new alternatives to known technologies.

SUMMARY

According to a first example aspect of the invention there is provided an apparatus comprising:

- a body;
- a rotating crusher element;
- a drive shaft arrangement configured to support the rotating crusher element to the body and to rotate the rotating crusher element; and
- a motor comprising a rotor for driving the drive shaft arrangement;
- the drive shaft arrangement being configured to form for the rotor a rotating axle that is rigidly coupled with the rotating crusher element and capable of leading inertia force or torque from the rotor to the rotating crusher element for overcoming peak loads in crushing or for rotating the crusher element around the drive shaft.

According to a second example aspect of the invention there is provided an apparatus comprising:

- a body;
- a rotating crusher element;
- a drive shaft arrangement configured to support the rotating crusher element to the body and to rotate the rotating crusher element; and
- a motor comprising a rotor for driving the drive shaft arrangement;
- the motor is formed inside the rotating crusher element;
- the drive shaft arrangement being configured to form for the rotor a rotating axle that is rigidly coupled with the rotating crusher element and capable of leading torque from the rotor to the rotating crusher element for rotating the crusher element around the drive shaft.

Advantageously, by rigidly coupling the rotor with the rotating crusher element, the mass and respectively induced momentum of the rotor is usable for increasing peak forces of the crusher element. The increasing of peak forces of the crusher element may help to overcome particularly demanding crushing events and help to mitigate risk of blockage.

Advantageously, by forming a motor that employs the driving shaft arrangement to support the rotor, separate bearings may be avoided from the motor. Moreover, external belts and pulleys need not be provided. Further still, energy efficiency may be greatly improved by removing the need of further bearings, power transmission elements and/or clutch elements. Avoiding clutch elements between the rotor and the crusher element may also reduce vibrations, noise, power loss and maintenance needs.

Further advantageously, noise and vibration is also damped by the mass of the crusher element and by the crushing material when the drive shaft arrangement is configured to form for the rotor the rotating axle that is rigidly coupled with the rotating crusher element.

The rotor may be integrally formed with the rotating crusher element.

Advantageously, by integrally forming the rotor and the rotating crusher element, a body for the rotor and the rotating crusher element may be manufactured in a single common process. The common process may be casting. In result, the failure prone mechanical connections and work stages may be reduced. Moreover, by integrally forming the rotor and the rotating crusher element, separate alignment of the rotor may be avoided.

The motor may be an electric motor. The electric motor may be a permanent magnet motor. A first part of the permanent magnet motor may be supported by the driving shaft arrangement and a second part of the permanent magnet motor may be supported by the body. The first part may comprise either permanent magnets or coils. The second part may comprise the what is remaining from the first part of permanent magnets and coils.

Advantageously, a permanent magnet motor may tolerate relative movements between the rotor and the stator of the motor caused by crusher elements through the rigid coupling with the common drive shaft arrangement. Moreover, the permanent magnet motor may provide sufficient torque at low speeds to enable starting of the apparatus without necessarily first clearing the apparatus of crushing material.

The motor may be a hydraulic motor. Alternatively, the motor may be a pneumatic motor.

Still further advantageously, total mass of the apparatus and/or the number of different bearings may be reduced in comparison to existing crushers using e.g. belt based power transmission from a bed-mounted motor with a belt and belt wheels.

The rotating crusher element may comprise an exterior surface configured to contact crushing material when in operation.

The motor may be cooled using the crushing material by conducting heat from the motor through the rotating crusher element to the crushing material.

The drive shaft arrangement may comprise a core shaft fixedly attached from two ends to the body. The drive shaft arrangement may further comprise a tubular member configured to rotate about the core shaft. The drive shaft arrangement may further comprise bearing between the core shaft and the tubular member. The bearing may comprise separate bearings at two ends of the rotating crusher element.

The body may form side walls and ends of the rotating crusher element may be supported by respective side walls. The motor may be formed inside the crusher element.

Advantageously, by forming the motor inside the crusher element, the crusher may be made compact as there is no need for space to accommodate either the motor or any power transmission outside the rotating crusher element or outside the body of the apparatus. Moreover, by forming the motor inside the crusher element, separate protective parts are not needed to prevent access to dangerous parts in power transmission. Still further, by forming the motor inside the crusher element, there is no motor or power transmission exposed to damaging e.g. by erroneous use of a digger feeding crushing material to the apparatus or during transport of the apparatus.

The shaft arrangement may extend through at least one of the side walls and respectively be connected with at least one flywheel for increasing the inertia (torque) of the rotating crusher element.

The rotor may be carried by the at least one flywheel. The motor may comprise two respective rotors and stators. One pair of a rotor and stator may be located at each end of the shaft arrangement.

The apparatus may be a horizontal shaft impactor (HSI). Alternatively, the apparatus may be a vertical shaft impactor (VSI). Further alternatively, the apparatus may be a roller crusher. Further alternatively, the apparatus may be a jaw crusher.

The apparatus may be an impact crusher wherein the rotating crusher element is configured to throw mineral material against wear parts of the crusher.

The rotating crusher element may comprise throwing means such as blow bars or a rotary disc for throwing mineral material.

The rotating crusher element may comprise an exterior surface configured to hit and break crushing material when in operation.

According to a third example aspect of the invention there is provided a method comprising:

supporting and rotating by a drive shaft arrangement a rotating crusher element by a motor comprising a rotor for driving the drive shaft arrangement;

forming by the drive shaft arrangement for the rotor a rotating axle that is rigidly coupled with the rotating crusher element and capable of leading inertia force or torque from the rotor to the rotating crusher element for overcoming peak loads in crushing or for rotating the crusher element around the drive shaft.

According to a fourth example aspect of the invention there is provided a method comprising:

supporting and rotating by a drive shaft arrangement a rotating crusher element by a motor comprising a rotor for driving the drive shaft arrangement;

forming the motor inside the rotating crusher element;

forming by the drive shaft arrangement for the rotor a rotating axle that is rigidly coupled with the rotating crusher element and capable of leading torque from the rotor to the rotating crusher element for rotating the crusher element around the drive shaft.

According to a fifth example aspect of the invention there is provided a jaw crusher comprising a body, a fixed crushing blade, a shaft which is arranged horizontally and in direction of a crushing surface of the crushing blade, and a pitman which is eccentrically movable in relation to the shaft, a movable crushing blade which is attached to the pitman, and an electric motor is arranged between the pitman and the shaft.

The electric motor may be attached to the shaft and configured to proceed the pitman in a movement in relation to the shaft.

A rotor of the electric motor may be connected to one of the following: the shaft and the pitman, and a stator of the electric motor may be connected to the other of said shaft and pitman.

Preferably a rotor part of the electric motor is fixed to the shaft and a stator part of the electric motor is fixed to the pitman.

Preferably the jaw crusher comprises a mass wheel (flywheel) at least in one end of the shaft and the rotor of the electric motor is fixed to the mass wheel.

Preferably the stator is around the rotor and the stator is fixed to the body.

Preferably the electric motor is a permanent magnet motor. A permanent magnet motor provides for a good efficiency and a good torsion moment already by low rotation speed.

According to a sixth example aspect of the invention there is provided a mineral material processing plant comprising a body construction to which body construction is attached a jaw crusher for mineral material crushing and at least one conveyor for conveying crushed mineral material, which jaw crusher comprises a body, a fixed crushing blade fixed to the body and a shaft which is arranged horizontally and in direction of a crushing surface of the crushing blade, and a pitman which is eccentrically movable in relation to the shaft, a movable crushing blade which is attached to the pitman, and an electric motor is arranged between the pitman and the shaft and configured to proceed the pitman in a movement in relation to the shaft.

Further the motor bed, wearing belts, belt wheels and machined grooves of the flywheel may not be required any longer. Design, manufacturing and service costs of crushers and crushing plants are decreasing because there may be no requirement for belts, separate motors beds or motor fixing attachments in crushers and crushing plants. The current bearings of the eccentric may be sufficient, the amount of bearings may be decreasing and there may required no wearing parts such as carbon brushes which is increasing the life of the crushing apparatus. In a jaw crusher the current return rod is sufficient for the torque support. The permanent magnet motor has a large torque in relation to the traditional electric motor and this is an advantage when the jaw crusher is started with a full jaw.

In preferred embodiments it is easy to change the direction the crusher element. Due to the direct drive there are less power losses.

The design of a movable processing plant is getting easier and there will be more freedom for positioning the components.

Different non-binding example aspects and embodiments of the present invention have been illustrated in the foregoing. The above embodiments are used merely to explain selected aspects or steps that may be utilized in implementations of the present invention. Some embodiments may be presented only with reference to certain example aspects of the invention. It should be appreciated that corresponding embodiments may apply to other example aspects as well.

BRIEF DESCRIPTION OF THE DRAWINGS

Some example embodiments of the invention will be described with reference to the accompanying drawings, in which.

DETAILED DESCRIPTION

In the following description, like reference signs denote like elements.

Figure 1A:
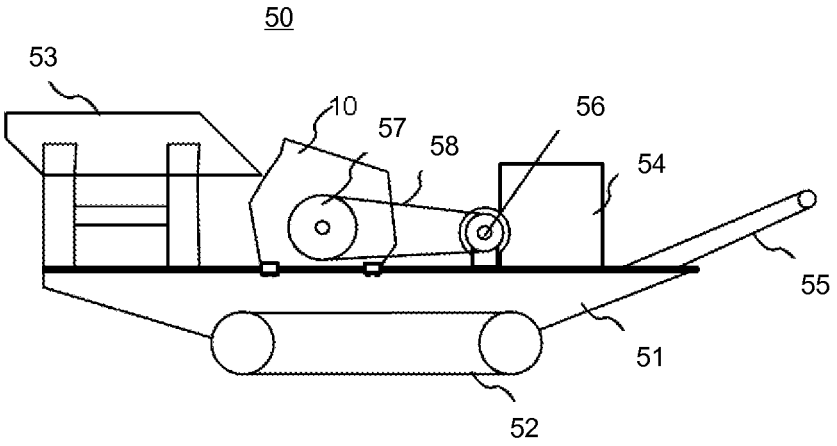
FIG. 1*a* shows a prior art track-mounted mobile horizontal shaft impactor (HSI) crushing station.
Figure 1B:
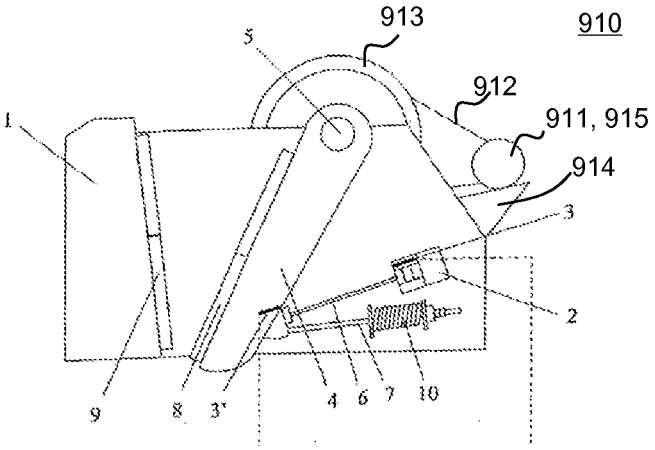
FIG. 1*b* shows a prior art jaw crusher.
Figure 1C:
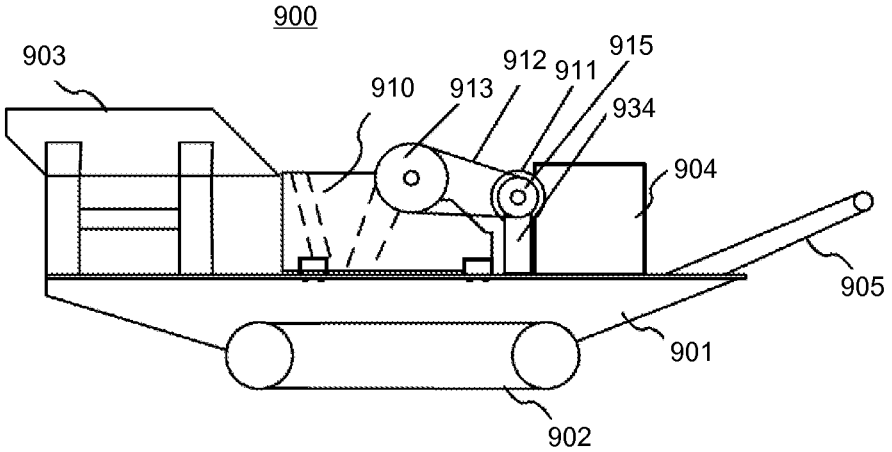
FIG. 1*c* shows a prior art track-mounted mobile jaw crushing station.
Figure 2:
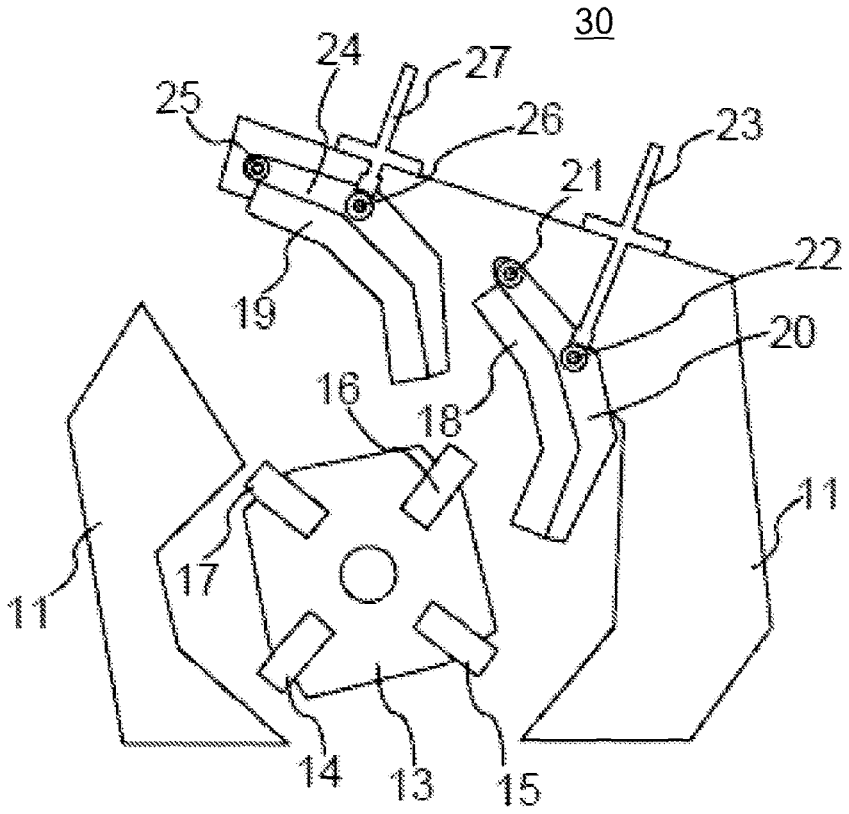
FIG. 2 shows a horizontal shaft impactor according to an embodiment of the invention.

FIG. 2 shows a simplified horizontal shaft impactor (HSI) crusher 30 designed to particularly though not exclusively for disintegrating mineral material such as stone and bricks. The HSI crusher 30 comprises, for example, a body 11, a rotor 13, blow bars 14 to 17 attachable (here attached) to the rotor 13, one or more wear parts 18, 19, one or more breaker plates 20, 24, first joints 21, 25 for joining the breaker plates 20, 24 to the body, adjustment means 23, 27 for adjusting the position of the breaker plates with relation to the body and with relation to the rotor 13, and second joints 22, 26 for joining the adjustment means to the breaker plates. In operation, the rotor rotates about its axle. The blow bars 14 to 17 hit and break stones when the rotor is rotating. Wear parts 18 and 19 are attached resiliently with to receive stones thrown by the blow bars 14 to 17. The resilient attaching or cushioning of the wear parts is implemented e.g. by resilient support structures behind the wear parts and/or by resilient adjustment means 23, 27 and/or resilient attachment of the adjustment means 23, 27 to the body 11. In one example, when a stone hits the wear part 18 or 19, a resilient part in the adjustment means 23, 27 such as helical or torsion springs let the adjustment means yield under impact. The wear part with hit by the stone with its supporting structure (breaker plate 20, 24) turns slightly about the first joint 21, 25 farther away from the rotor 13 and then resumes again if not held back by other stones hitting the wear part 18, 19.

Figure 3:
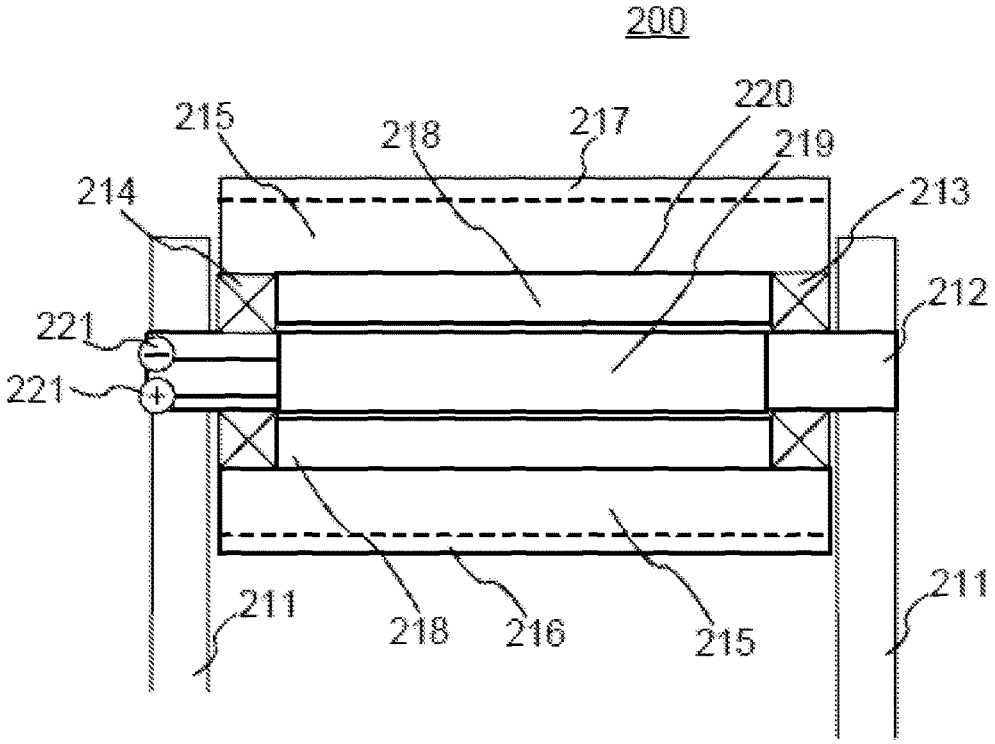
FIG. 3 shows a first apparatus suitable for use in the crusher of FIG. 2.

FIG. 3 shows in further detail a rotor arrangement or a first apparatus 200 suitable for use in the HSI crusher 30. The first apparatus 200 comprises a body 211 (side walls not shown in FIG. 2), a rotating crusher element or a rotor body 215 (cf. rotor 13 in FIG. 2). The first apparatus 200 further comprises a shaft 212 fixed to the body 211 configured to support the rotating crusher element or the rotor body 215 by bearings 213, 214. The rotor body 215 has a cylindrical wall 220 configured to surround the shaft 212. Between the cylindrical wall 220 of the rotor body 215 and the shaft 212 there are a stator 219 of an electric motor fixed to the shaft 212 and a rotor 218 of the electric motor fixed to the cylindrical wall.

The shaft 212 and the rotor body together form a driving shaft arrangement that supports the rotating crusher element or rotor body 215. The driving shaft arrangement also forms supporting parts of the electric motor. Thus, the drive shaft arrangement forms for the rotor 218 a rotating axle. The rotor 218 is rigidly coupled with the rotating crusher element 215 and capable of leading inertia force (torque) from the rotor 218 of the electric motor to the rotating crusher element 215 for overcoming peak loads in crushing. Thus, the mass of the rotor of the electric motor may also help the rotor body to exert force on the material to be crushed at peak load and to mitigate blockage risk.

In an example embodiment, the electric motor is a permanent magnet motor, in which case the permanent magnets are attached to the stator or to the rotor. Coils are provided in the remaining part. If the coils are attached to the stator 219, the coils can be simply connected to power supply 221 through the shaft 212. On the other hand, if the coils are attached to the rotor 218 of the electric motor, then current to the coils is passed to the coil through conductive, capacitive or inductive coupling from a static part such as the body 212 or from the shaft 212. In one example embodiment, contactless power transfer coils are provided at an end of the rotor body 215 and at proximate structure of the body 212. The contactless power transfer coils can also be arranged to operate as a transformer.

Figure 4A:
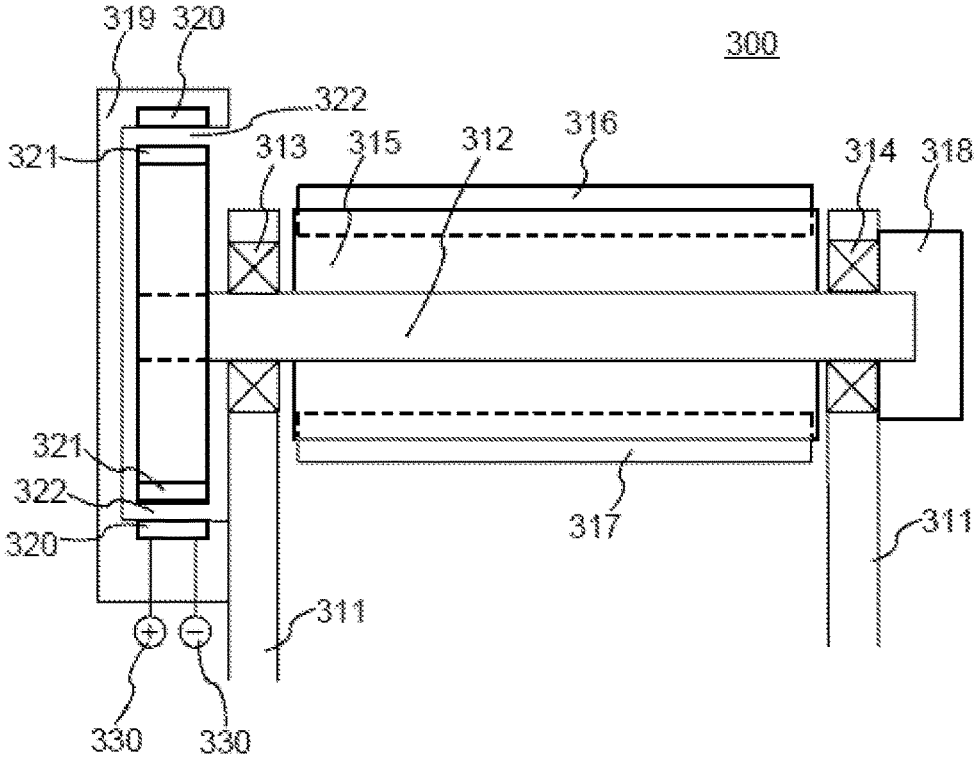
FIG. 4*a* shows a second apparatus suitable for use in the crusher of FIG. 2.

FIG. 4*a* shows in further detail another rotor arrangement or a second apparatus 300 suitable for use in the HSI crusher 30. In the second apparatus, a motor is constructed on a common axle 312 with a rotating crusher element or the rotor 13 of FIG. 2. The common axle 312 is supported by bearings 313 and 314 and extends to a rotor 321 of the motor outside a casing formed by a body 311 or side walls of the HSI crusher 30. Surrounding the rotor of the motor there is, in the example embodiment of FIG. 4*a*, a stator 320 attached to a stator body 319. The stator body 319 is formed, in one example embodiment, integrally with the body 311 of the HSI crusher.

The rotor 321 of the motor is configured, in the example embodiment shown in FIG. 4*a*, to form a flywheel for further increasing the inertia available to the rotating crusher element.

Figure 4B:
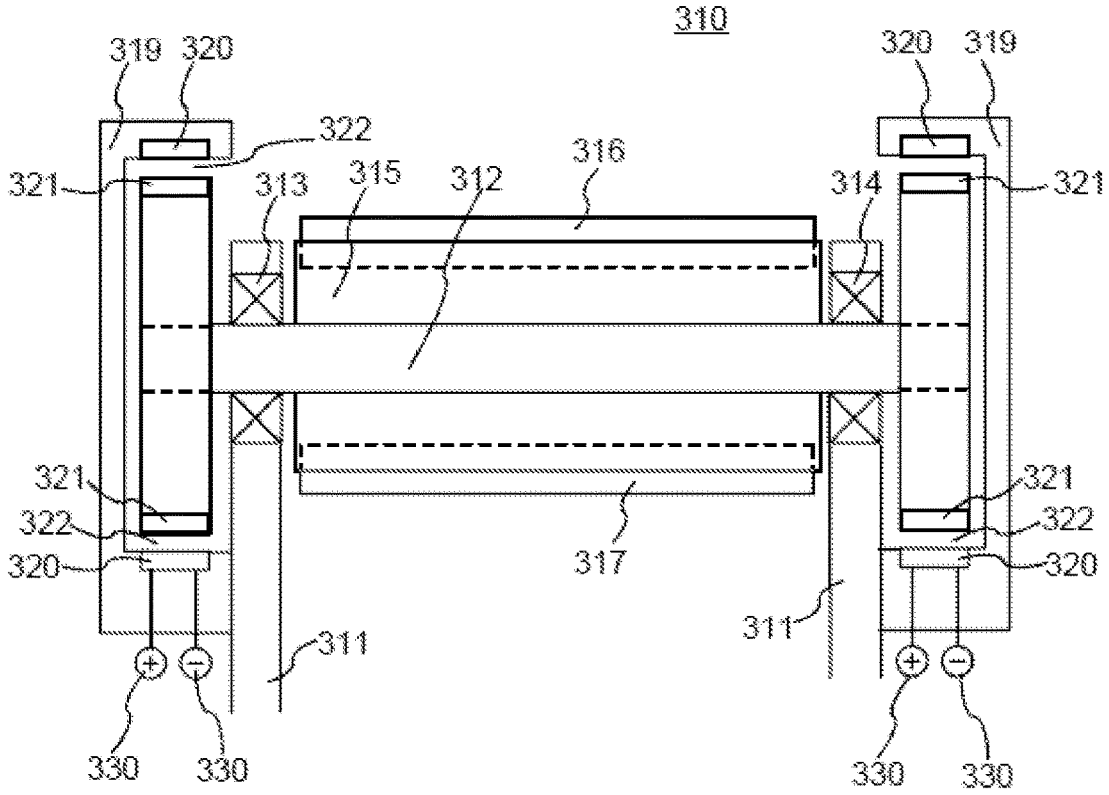
FIG. 4*b* shows a third apparatus suitable for use in the crusher of FIG. 2.

Between the rotor 321 of the motor and the stator 320 FIG. 4*b* shows a gap 322 that is dimensioned taking into account manufacturing tolerances of the rotor 321 and stator 320 as well as the tolerances in straightness and bending of the axle 312 and the tolerances of the bearings 313, 314.

At an end of the shaft opposite to the motor, there is a hood 318 protecting the end of the common axle 312 from mechanical impacts from outside. At the motor end of the common axle 312, the stator body and the body 311 or side wall of the HSI crusher 30 form an enclosure for the motor. The enclosure may be sealed to avoid entry of dust and dirt into the motor.

Power supply 330 to the motor is provided through the stator body 319.

FIG. 4*b* shows a in further detail another rotor arrangement or a third apparatus 310 suitable for use in the HSI crusher 30. The third apparatus has a motor as in FIG. 4*a* constructed on each end of the common axle 312. With two motors, greater momentum can be provided than with a single motor. Moreover, by driving the common axle through both ends, it may be possible to further reduce vibrations as the axle is symmetrically burdened by two rotors 321 of electric motors and as force can be evenly brought to the axle from both ends.

Figure 5A:
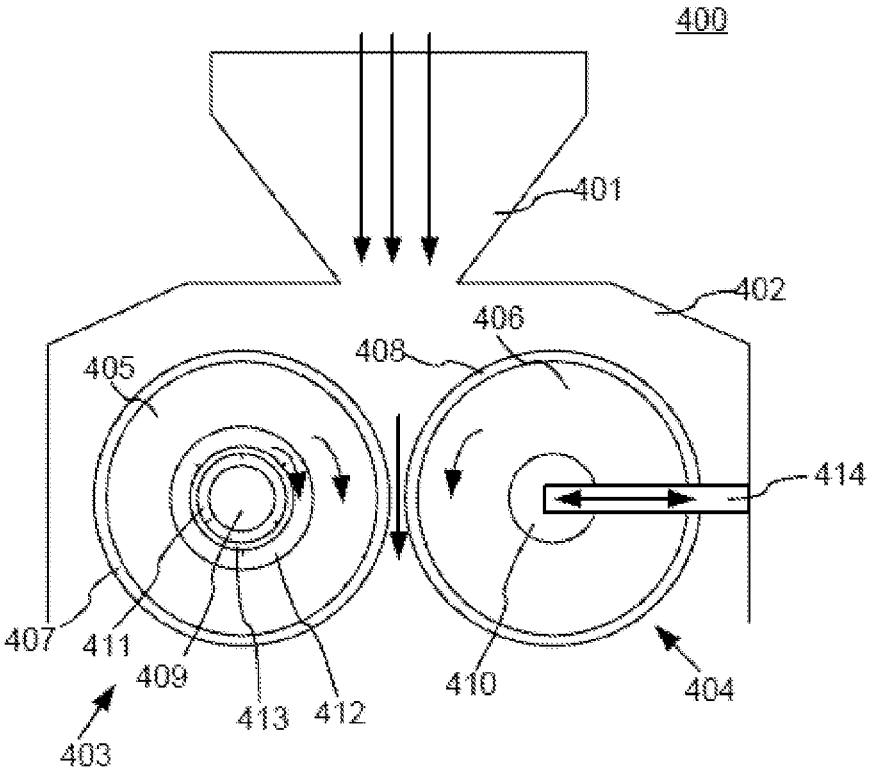
FIG. 5*a* shows a fourth apparatus according to an example embodiment.

FIG. 5*a* shows a schematic drawing of a roller crusher 400 or a fourth apparatus according to an example embodiment. The roller crusher 400 comprises an input chute 401 for receiving material to be disintegrated. Below the input chute 401, there is a casing 402 surrounding adjacent first crushing roll 403 and second crushing roll 404. The first crushing roll 403 is fixedly supported in place with a shaft 409. The second crushing roll 404 is supported with gap adjustment 414 with relation to the first crushing roll 403. The first crushing roll 403 has a fixed shaft 409 and a stator 411 attached to the shaft 409. The first crushing roll 403 further has a cylindrical cavity surrounding the shaft 409 with a cylindrical inner wall on which a rotor 412 is attached with a coil or windings 413. The first crushing roll 403 further has a first roll body 405 the interior side of which forms the cylindrical inner wall and the exterior side of which carries a crushing layer configured to face impacts and abrasion caused by the material being crushed.

The crusher roll 404 also comprises a second roll body 406 although there is a smaller cylindrical boring or cavity about the rotation axis of the second roll body 406. In one example embodiment there is no separate axle but instead a bearing is attached at each end of the second roll body 406. As a rotation axle, the second roll body 406 may comprise an axle 410 that rotates along with the roll body or about which the roll body 406 rotates.

The first crushing roll 403 is driven by a motor formed inside the first crushing roll. As with some other example embodiments, the windings or coils may be arranged on either side, although coils on a the stator may be simpler to arrange. The gap adjustment 414 may comprise a resilient biasing member such as e.g. a spring, piece of resilient material or pneumatic biasing element, configured to bias the second crushing roll 404 against the first crushing roll 403. When the first crushing roll 403 is driven by the motor inside, the second crushing roll 404 is driven by the abutting crushing layers 407, 408 of the first and second crushing rolls 403 and 404, respectively.

Figure 5B:
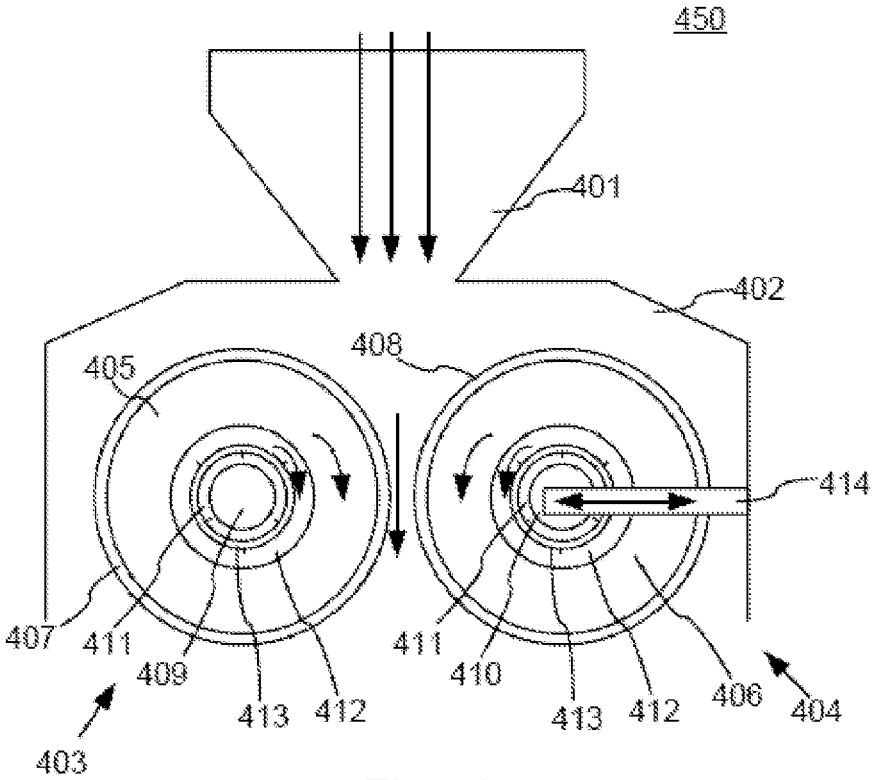
FIG. 5*b* shows a fifth apparatus according to an example embodiment.

FIG. 5*b* shows a schematic drawing of another roller crusher 450 or a fifth apparatus according to an example embodiment. The fifth apparatus of FIG. 5*b* is otherwise drawn as the fourth apparatus except a second crushing roll 404' of FIG. 5*b* also has a built-in motor alike the first crushing roll 403.

Figure 6A:
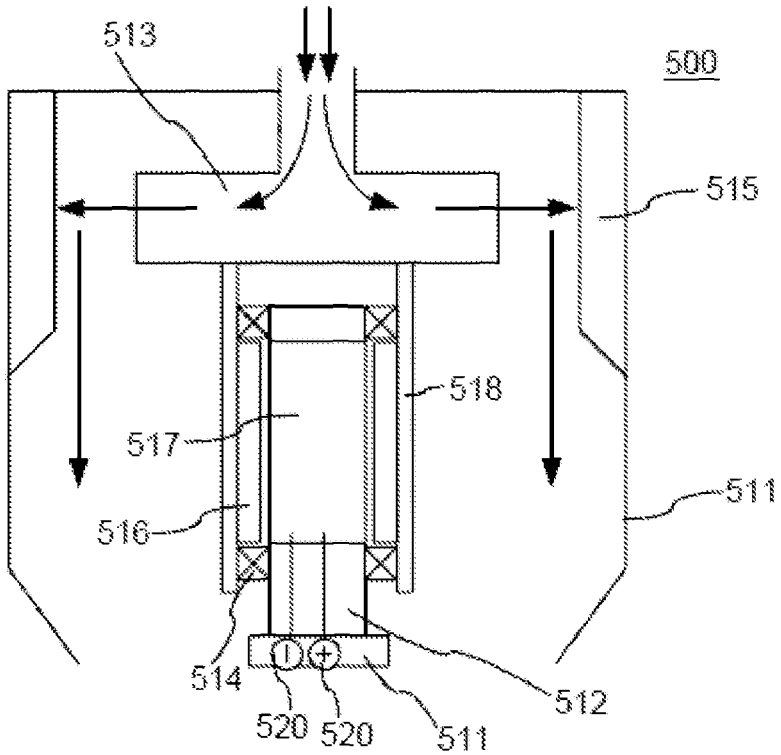
FIG. 6*a* shows a sixth apparatus according to an example embodiment.

FIG. 6*a* shows a schematic drawing of a vertical shaft impactor (VSI) 500 or a sixth apparatus according to an example embodiment. The VSI impactor 500 comprises an enclosure 511 with sidebars 515, top input and a rotary disc 513 configured to throw crushing material against the sidebars. The rotary disc 513 is supported and driven by a driving shaft arrangement that comprises a fixed shaft 512 that comprises a stator 517 of an electric motor and a power input 520. About the fixed shaft 512 there is a tubular rotor body 518 comprising a rotor 516 of the electric motor. The rotor is rotatably supported by the fixed shaft with bearings 514 around the stator. The fixed shaft is attached to a body 511 of the VSI impactor 500 from its lower end. Coils or windings in the stator are electrified with power input 520. Thus, when powered, the motor formed by the stator 517 and by the rotor 516 starts to rotate the rotor body 518 and attached thereto the rotary disc 513 starts to rotate.

While the rotor body 518 is drawn to have relatively thin walls, thicker walls are usable for further increasing the inertia of the rotary disc 513.

Figure 6B:
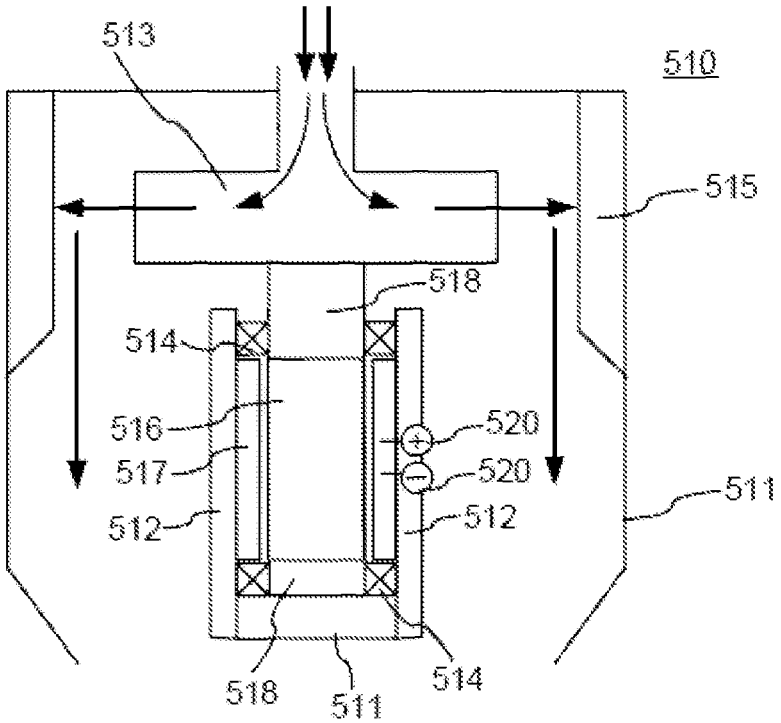
FIG. 6*b* shows a seventh apparatus according to an example embodiment.

FIG. 6*b* shows a schematic drawing of another vertical shaft impactor (VSI) 500 or a seventh apparatus according to an example embodiment. Compared to FIG. 6*a*, this apparatus differs in that the rotor 516 is supported by a shaft 528 attached to the rotary disc 513 and the stator 517 is cylindrically surrounding the rotor.

Figure 7:
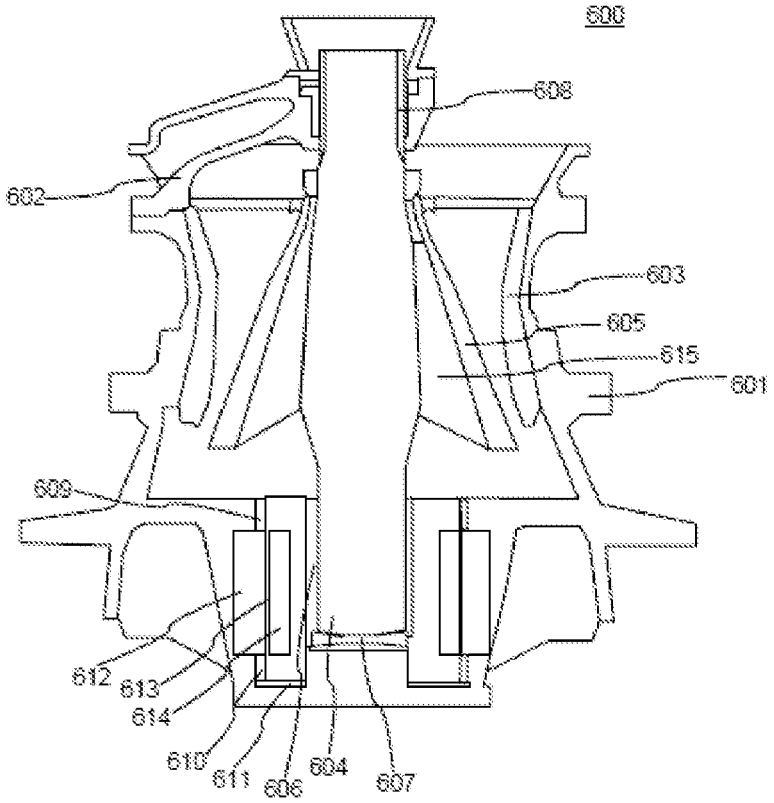
FIG. 7 shows an eighth apparatus according to an example embodiment.

FIG. 7 shows a gyratory crusher 600 or an eighth apparatus according to an example embodiment. The gyratory crusher comprises a frame 601, an arm 602, an outer crushing blade 603, a main shaft 604, an inner crushing blade 605, an eccentric bushing 606, thrust bearing plates 607, a top bearing 608, a frame bushing 609/610, a thrust bearing 611, a stator with windings 612, an air gap 613, a rotor of permanent magnets 614 and a head 615.

Figure 8:
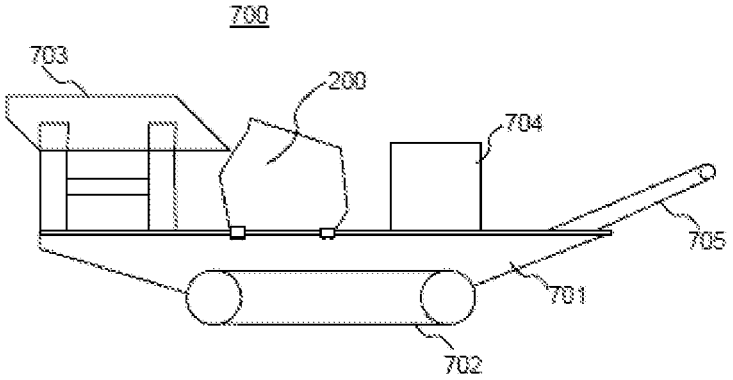
FIG. 8 shows a first mobile crushing station according to an example embodiment.

FIG. 8 shows a first mobile crushing station 700 according to an example embodiment. The first mobile crushing station 700 comprises a body 701 and traction elements 702 connected on both sides of the body 701 for moving the mobile crushing station 700. Fixed to the body 701 there are also, in series, an input feeder 703, a crusher such as the HSI crusher 200, and an output conveyor 705 for removing crushed material. Also carried by the body 701 there is a power station 704 configured to provide operating power for different power-dependent elements of the mobile crushing station 700, such as the input feeder, crusher 200, output conveyor 705 and for the traction elements 702. The power station 704 comprises, in one example embodiment, an engine such as a petrol engine, diesel engine or fuel cell engine. For using an electric motor to drive the crusher 200, the power station 704 further comprises a generator. If, on the other hand, the motor in the crusher is a pneumatic or hydraulic motor, the power station 704 comprises a corresponding pneumatic or hydraulic pump.

Figure 9A:
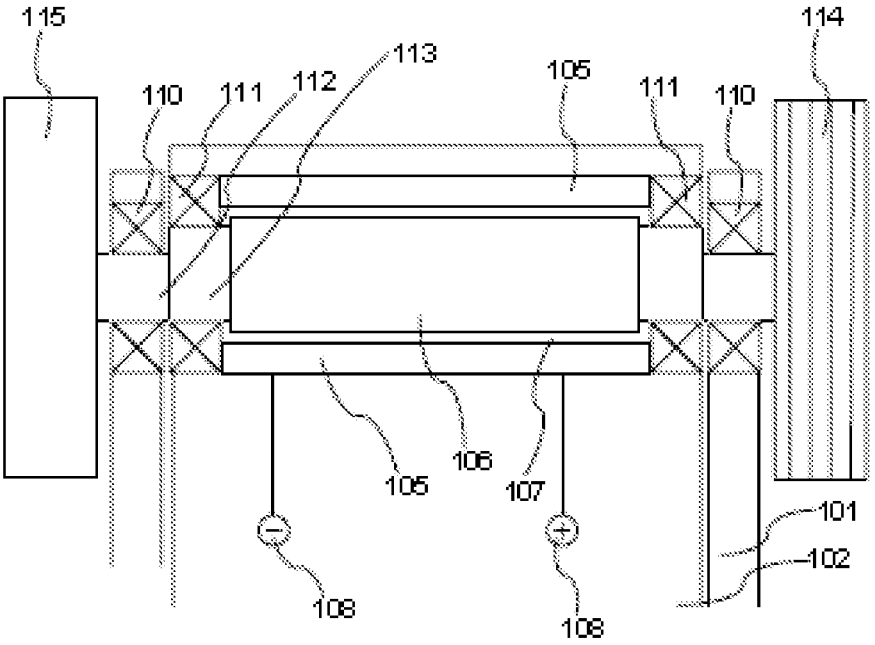
FIG. 9*a* shows an ninth apparatus according to an example embodiment.

FIG. 9*a* shows a cross section of a ninth apparatus, a jaw crusher, according to an example embodiment. The crusher comprises a body 101 and a pitman 102 (a rotating crusher element) and a movable crushing blade is fixed to the pitman. A shaft 112 (a rotating axle) is supported to the body 101 by means of first bearings 110 enabling rotating of the shaft around its longitudinal axis. The shaft 112 comprises an eccentric portion 113 which is supported to the pitman 102 via second bearings 111 enabling changing the rotation movement which is generated by the rotation of the shaft to a back and forth movement in a known way. Further the crusher comprises two mass wheels 114 and 115 (flywheels) for generating the moment required in the crushing.

Further the jaw crusher comprises an electric motor 105-108 which is arranged inside the pitman 102 around the shaft, the electric motor comprising a stator 105, a rotor 106, an insulation gap such as an air gap 107 between the rotor 106 and the stator 105 and electric wires 108 for the coils of the stator (not shown in the Figure). In an embodiment according to the invention the rotor part 106 is fixed around the eccentric portion 113 of the shaft 112. For example a bolt joint, cold or hot shrinkage joining, soldering, welding or bonding can be used as joining methods for the rotor part 106. The stator 105 is fixed in a cylindrical opening which is made (for example machined) inside the pitman 102 in a region between the second bearings 111. Preferably the rotor 106 comprises permanent magnets wherein coils and wires for generating a magnetic field are not required.

Electric wires 108 relating to the coils of the stator 105 are preferably brought on a rear surface of the pitman 102.

The cooling required by the electric motor 105-108 can be ensured by making for example a cooling rib construction on the rear surface and/or an upper surface of the pitman in immediate vicinity of the electric motor.

The jaw crusher according to the invention provides a higher torque than known solutions what enables starting of the crushing even then when there is material to be crushed in the jaw of the crusher.

The electric motor enables changing the rotation direction of the pitman when a suitable control electronics is used.

In an embodiment of the invention the width of the stator 105 is 600 mm, the outer diameter 600 mm and the inner diameter circa 400 mm. The outer diameter of the rotor 106 is circa 400 and the inner diameter 340 mm. The air gap 107 between the rotor and the stator is circa 1 mm. The power of the motor according to the above dimensions is 132 kW with a rotation speed n=230 1/min and torque M=5500 Nm.

Figure 9B:
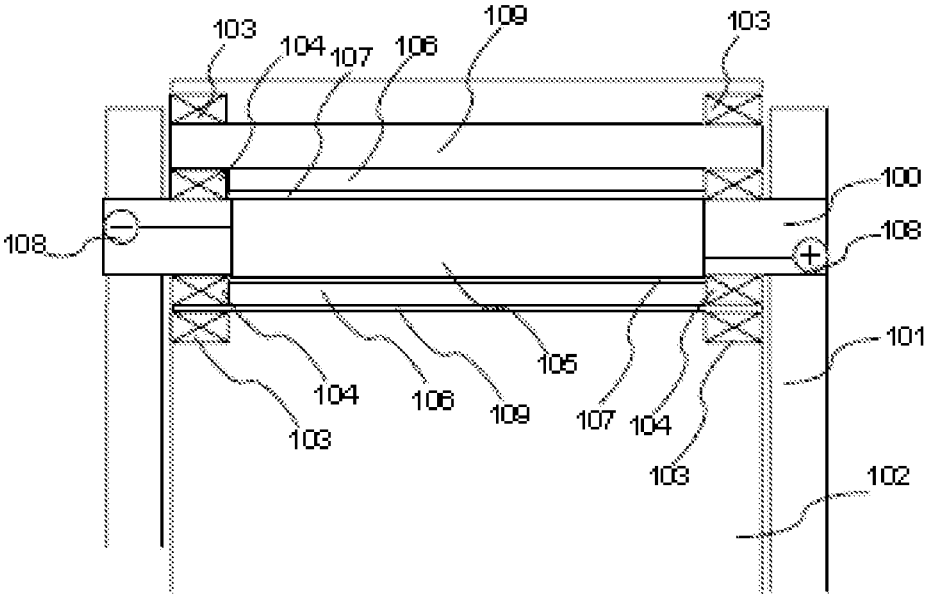
FIG. 9*b* shows a tenth apparatus according to an example embodiment.

FIG. 9*b* shows a cross section of a tenth apparatus, a jaw crusher, according to an example embodiment. This embodiment is differing from the example of FIG. 9*a* in that the shaft 100 (a core shaft) is now fixed at its both ends in relation to the body 101 wherein the shaft is acting as the stator 105 of the electric motor. It is preferable to bring the electric wires 108 relating to the coils of the stator 105 via the shaft 100 to the outer periphery of the crusher for example through channels machined to the shaft 100.

The rotor 106 of the electric motor which comprises preferably permanent magnets is fixed to an eccentric cylinder 109 at a distance of an insulation gap 107 from the shaft 100. The eccentric cylinder 109 (a tubular member configured to rotate about the core shaft, e.g. a bushing) is supported by third bearings 104 to the shaft and by fourth bearings 103 to the pitman 102. This arrangement enables a rotation movement of the eccentric cylinder around the shaft 100 and the back and forth movement of the pitman.

Because there are no separate mass wheels in this embodiment a sufficient momentum has to be generated by the electric motor and the pitman. In order to increase the momentum the mass of the pitman can be increased by casting the pitman in one part or by fixing further masses to the pitman 102.

Figure 9C:
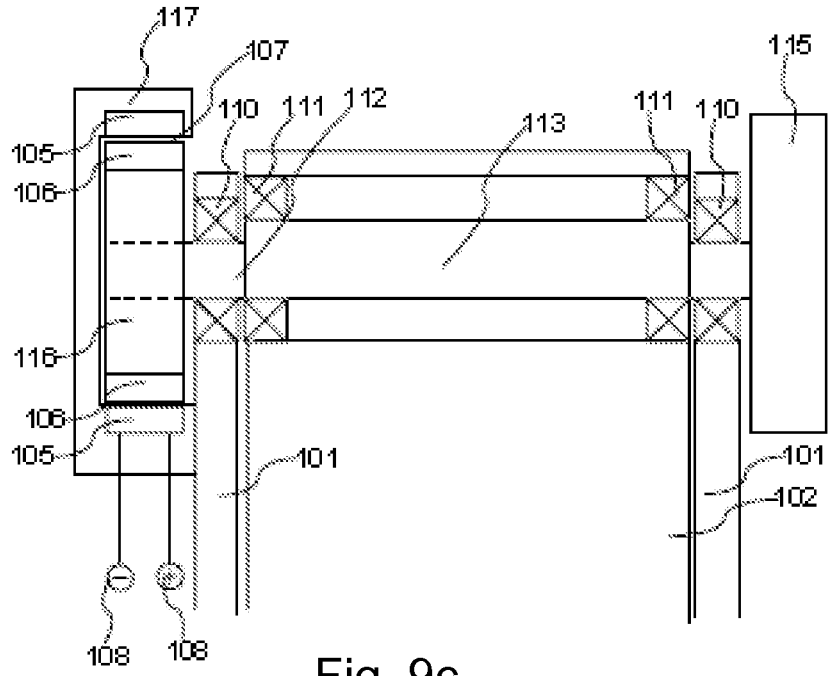
FIG. 9*c* shows an eleventh apparatus according to an example embodiment.

FIG. 9*c* shows a cross section of an eleventh apparatus, a jaw crusher, according to an example embodiment where the embodiment in relation to the construction of the pitman 102 and the eccentric 113 is according to FIG. 9*a* but the electric motor is located between a first mass wheel 116 and a first support structure 117 surrounding the mass wheel. The rotor 106 is fixed on an outer surface of the first mass wheel 116 and the stator 105 is fixed on an inner circumference of the first support structure 117 and the first support structure is fixed to the body 101 of the jaw crusher, preferably to a side portion, for example to the side plate. The electric wires 108 of the stator 106 can preferably be brought through the first support structure 117 at an outer surface of the first support structure where an appropriate electric coupling can be arranged.

Figure 9D:
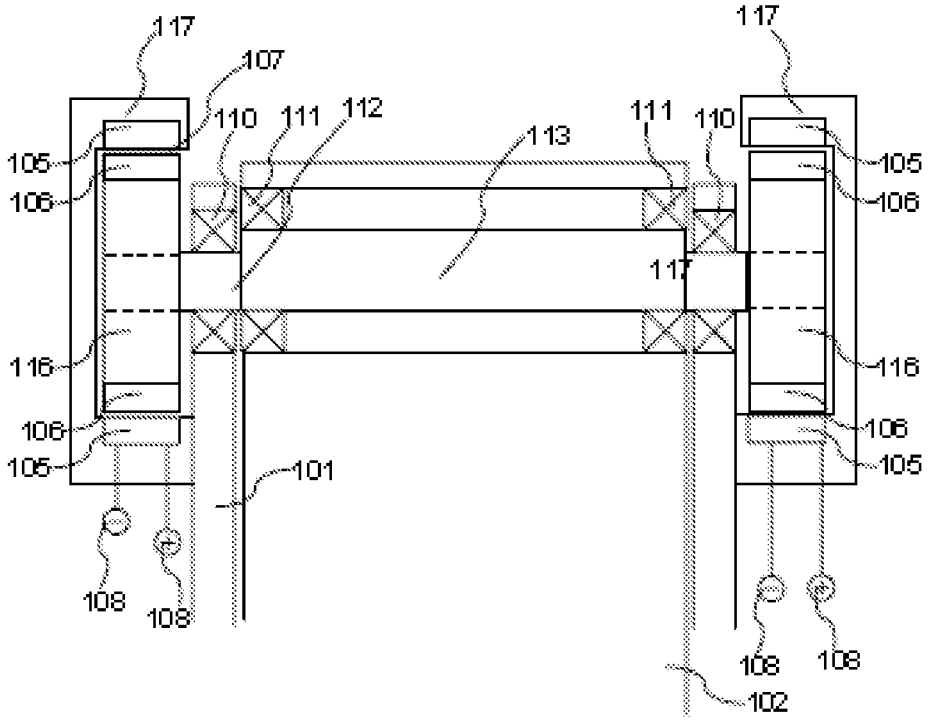
FIG. 9*d* shows a twelfth apparatus according to an example embodiment.

FIG. 9*d* shows a twelfth apparatus, a jaw crusher, according to an example embodiment. FIG. 9*d* shows an alternative embodiment for the embodiment of FIG. 9*c*. In this embodiment two electric motors are arranged on the shaft, each of them on one mass wheel fixed at the ends of the shaft. This embodiment provides a higher torque than in the solution of FIG. 9*c* or the motors can be lower in power than the motor of FIG. 9*c*. The torque is distributed more evenly because the forces are directed substantially equally on both sides of the crusher.

Due to the support structures shown in FIGS. 9*c* and 9*d* a separate cover around the mass wheels is not required any longer with the exception of the second mass wheel 115 of FIG. 9*c* because the support structure itself can be designed so that it covers totally the driving mass wheel 116. In case the electric motor is used in very hot circumstances or the electric motor requires cooling the mass wheel 116 may be designed so that during rotation movement the mass wheel is blowing or sucking cooling air through cooling openings which are arranged in the support structure (not shown in the Figure).

Figure 10:
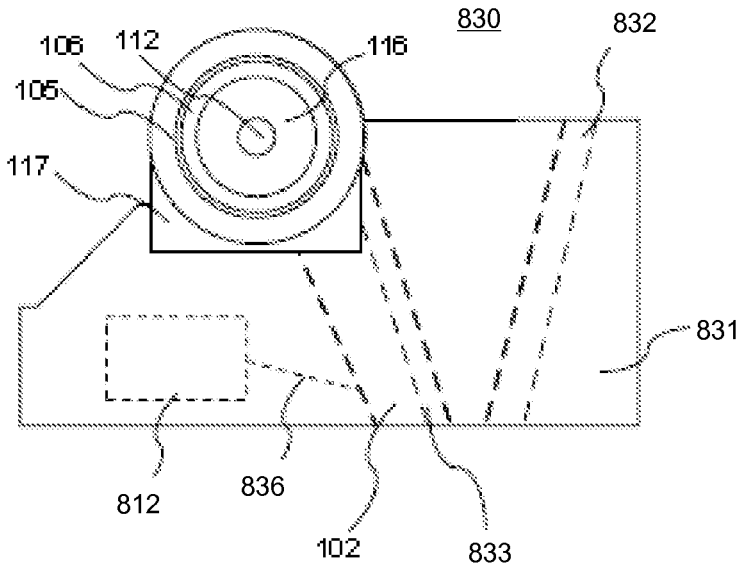
FIG. 10 shows a jaw crusher according to an embodiment of the invention.

FIG. 10 shows a jaw crusher 830 according to an embodiment of the invention comprising a body 831, a fixed crushing member 832 and a movable crushing member 833 which are forming a jaw of the crusher. The movable crushing member is fixed to the pitman 102 which is moving back and forth with a circumferential symmetric movement (rotational movement) by means of the eccentric and the shaft 112 when viewed at the upper end of the pitman. Additionally the crusher comprises a toggle plate 836 for supporting the pitman to the body of the crusher and adjusting means 812 for adjusting the setting of the crusher.

The crusher comprises additionally an electric motor 105, 106, 116, 117 according to some embodiment of the invention. The electric motor is arranged substantially in connection with the shaft and/or pitman of the crusher.

The body of the jaw crusher may be implemented in many ways. The body may be casted, welded or mounted with bolt joints of one or several parts. The jaw crusher may comprise a front end and separate plate-like side parts and a rear part. The support structures 117 according to FIGS. 9*c* and 9*d* can be fixed to the side parts such as side plates and/or the rear part at the side of the pitman.

The construction of the jaw crusher can be simplified because the power source is not required to couple through the V-belts to the belt wheel of the crusher and a known separate motor bed is not required.

Figure 11:
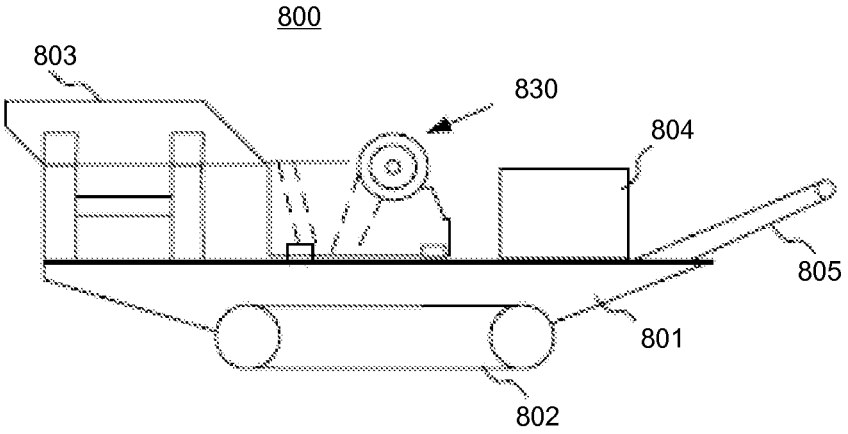
FIG. 11 shows a second mobile crushing station according to an example embodiment.

FIG. 11 shows a second mobile crushing station 800 (a processing plant) according to an example embodiment. The second mobile crushing station 800 comprises a body 801 and traction elements 802 connected on both sides of the body 801 for moving the mobile crushing station 800. Fixed to the body 801 there are also, in series, an input feeder 803 such as a vibration feeder, a crusher such as the jaw crusher 830, and an output conveyor 805 for removing crushed material. Also carried by the body 801 there is a power station 804 configured to provide operating power for different power-dependent elements of the mobile crushing station 800, such as the input feeder, crusher 830, output conveyor 805 and for the traction elements 802. The power station 804 comprises, in one example embodiment, an engine such as a petrol engine, diesel engine or fuel cell engine. For using an electric motor to drive the crusher 830, the power station 804 further comprises a generator. If, on the other hand, the motor in the crusher is a pneumatic or hydraulic motor, the power station 804 comprises a corresponding pneumatic or hydraulic pump. The feeder may also comprise a scalper. The crushing station may also comprise one or more screens such as a multi-deck screen. Preferably the feeder comprises also at least one output conveyor for conveying the crushed or screened material for example to a pile or to a following crushing or screening phase. The processing station 800 may be a stationary plant or movable for instance by means of wheels, tracks, legs or runners.

The body 801 and a track base 802 enable an independent movement of the processing plant of the example for instance from a transport carriage to the crushing site. When the mineral material processing plant is wheel based the base may be constructed such as a trailer of a truck wherein the base may be moved by a truck, an excavator, a loader or another device.

Operation of the processing plant is described in the following. The material to be crushed is brought to the feeder 803 by for example a loader or an excavator. The feeder (which typically is acting according to the principle of an eccentric) feeds the material towards the jaw of the jaw crusher 830. In case there is a scalper and/or a screen in connection with the feeder the fine fraction may be separated and lead directly to the output conveyor 805 or the fine material may be conveyed to be screened to a screening means of the processing plant such as a multi-deck screen.

Different example embodiments of the present invention provide various technical effects and advantages. For instance, by forming a motor that employs the driving shaft arrangement to support the rotor of the motor, separate bearings may be avoided from the motor, see e.g. shaft 212 in FIG. 3 and axle 312 in FIGS. 4*a* and 4*b*. Moreover, external belts and pulleys need not be provided for driving of the crusher element. Further still, energy efficiency may be greatly improved by removing the need of further bearings, power transmission elements and/or clutch elements. Moreover, by avoiding e.g. clutch elements between the rotor of the motor and the crusher element may also reduce vibrations, noise, power loss and maintenance needs.

Further advantageously, noise and vibration can be damped by the mass of the crusher element and by the crushing material when the drive shaft arrangement is configured to form for the rotor the rotating axle that is rigidly coupled with the rotating crusher element.

The crushing material may conduct heat away from the motor for example in embodiments where the motor is built in the rotating crusher element and where the rotating crusher element contacts the crushing material.

The rotor of the motor may be integrally formed with the rotating crusher element, see e.g. FIGS. 3, 5*a*, 5*b*, or 9*a* to 9*d* (described in the following).

Advantageously, a permanent magnet motor may tolerate relative movements between the rotor and the stator of the motor caused by crusher elements through the rigid coupling with the common drive shaft arrangement. Moreover, the permanent magnet motor may provide sufficient torque at low speeds to enable starting of the apparatus without necessarily first clearing the apparatus of crushing material.

Still further advantageously, total mass of the apparatus and/or the number of different bearings may be reduced in comparison to existing crushers using e.g. belt based power transmission from a bed-mounted motor with a belt and belt wheels.

The rotating crusher element may comprise an exterior surface configured to contact crushing material when in operation.

The drive shaft arrangement may comprise a core shaft fixedly attached from one or two ends to the body e.g. as the shaft 212 in FIG. 3. The drive shaft arrangement may further comprise a tubular member (e.g. rotor body 215 with cylindrical wall 220) configured to rotate about the core shaft.

The body may form side walls and ends of the rotating crusher element may be supported by respective side walls. The motor may be entirely formed inside the crusher element. Thus, the crusher may be made compact so removing need for space to accommodate either the motor or any power transmission outside the body of the apparatus. Moreover, by forming the motor inside the crusher element, separate protective parts are not needed to prevent access to dangerous parts in power transmission. Still further, by forming the motor inside the crusher element, there is no motor or power transmission exposed to damaging e.g. by erroneous use of a digger feeding crushing material to the apparatus or during transport of the apparatus.

The apparatus may be a horizontal shaft impactor (HSI), see e.g. FIGS. 2 to 4*b*. Alternatively, the apparatus may be a vertical shaft impactor (VSI), see e.g. FIGS. 6*a* and 6*b*. Further alternatively, the apparatus may be a roller crusher, see e.g. FIGS. 5*a* and 5*b*. Further alternatively, the apparatus may be a gyratory crusher, see e.g. FIG. 7. Further alternatively, the apparatus may be a jaw crusher, see e.g. FIGS. 9*a* to 10.

Various embodiments have been presented. It should be appreciated that in this document, words comprise, include and contain are each used as open-ended expressions with no intended exclusivity.

The foregoing description has provided by way of non-limiting examples of particular implementations and embodiments of the invention a full and informative description of the best mode presently contemplated by the inventors for carrying out the invention. It is however clear to a person skilled in the art that the invention is not restricted to details of the embodiments presented above, but that it can be implemented in other embodiments using equivalent means or in different combinations of embodiments without deviating from the characteristics of the invention.

Furthermore, some of the features of the above-disclosed embodiments of this invention may be used to advantage without the corresponding use of other features. As such, the foregoing description shall be considered as merely illustrative of the principles of the present invention, and not in limitation thereof. Hence, the scope of the invention is only restricted by the appended patent claims.

The invention claimed is:

1. A mineral material impact crusher comprising:

a body;

a rotating crusher element which is configured to throw mineral material against wear parts of the crusher;

a drive shaft arrangement configured to support the rotating crusher element to the body and to rotate the rotating crusher element; and a motor comprising a rotor for driving the drive shaft arrangement;

characterized in that the motor is formed inside the rotating crusher element;

the drive shaft arrangement being configured to form for the rotor a rotating axle that is rigidly coupled with the rotating crusher element and capable of leading torque from the rotor to the rotating crusher element for rotating the crusher element around the drive shaft.

2. The crusher of claim 1, wherein the rotor is integrally formed with the rotating crusher element.

3. The crusher of claim 2, wherein the body for the rotor and the rotating crusher element are by integrally formed.

4. The crusher of claim 1, wherein the motor is an electric motor.

5. The crusher of claim 4, wherein the electric motor is a permanent magnet motor.

6. The crusher of claim 1, wherein the rotating crusher element comprises an exterior surface configured to contact crushing material when in operation.

7. The crusher of claim 1, wherein the drive shaft arrangement comprises a core shaft fixedly attached to the body.

8. The crusher of claim 7, wherein the drive shaft arrangement further comprises a tubular member configured to rotate about the core shaft.

9. The crusher of claim 1, wherein the shaft arrangement extends through at least one of the side walls of the body and is connected with at least one flywheel for increasing the inertia of the rotating crusher element.

10. The crusher of claim 9, wherein the rotor is carried by the at least one flywheel.

11. The crusher of claim 10, wherein the motor comprises two respective rotors and stators.

12. The crusher of claim 11, wherein one pair of the rotor and of the stator is located at each end of the shaft arrangement.

13. The crusher of claim 1, wherein the crusher is a horizontal shaft impactor.

14. The crusher of claim 1, wherein the crusher is a vertical shaft impactor.

15. The crusher of claim 1, wherein the shaft arrangement is supported at its both ends by the body of the crusher.

16. The crusher of claim 1, wherein the rotating crusher element comprises throwing means for throwing mineral material.

17. The crusher of claim 1, wherein the rotating crusher element comprises an exterior surface configured to hit and break crushing material when in operation.

18. The crusher of claim 1, wherein the rotating crusher element comprises blow bars for throwing mineral material.

19. A method comprising:

supporting a rotating crusher element of a mineral material impact crusher by a drive shaft arrangement;

rotating the rotating crusher element by the drive shaft arrangement using a motor that resides inside the rotating crusher element and comprises a rotor rigidly coupled with the rotating crusher element by driving the rotor; and throwing mineral material against wear parts of the crusher by rotating the rotating crusher element.

* * * * *